US005271183A

United States Patent [19]

Hahn et al.

[11] Patent Number: 5,271,183

[45] Date of Patent: Dec. 21, 1993

[54] SAFETY BARRIER ASSEMBLY

[75] Inventors: Norbert Hahn, Franklin; Gregory S. Hahn, Milwaukee; Michael A. Swessel, Cudahy, all of Wis.

[73] Assignee: Rite-Hite Corporation, Milwaukee, Wis.

[21] Appl. No.: 951,219

[22] Filed: Sep. 25, 1992

[51] Int. Cl.[5] ..... E05F 11/00

[52] U.S. Cl. ..... 49/360; 49/73.1; 49/103

[58] Field of Search ..... 49/360, 362, 103, 73, 49/68, 69, 9; 100/202

[56] References Cited

U.S. PATENT DOCUMENTS

| | | | |
|---|---|---|---|
| 1,652,186 | 12/1927 | Strauss | 49/360 X |
| 1,698,424 | 1/1929 | Banschbach | 49/360 X |
| 2,282,914 | 5/1942 | Vetterlein | 160/202 X |
| 2,956,518 | 10/1960 | Sabol et al. | 160/202 X |
| 3,394,497 | 7/1968 | Case | 49/360 X |
| 3,886,851 | 6/1975 | Berner | 160/202 X |
| 4,927,198 | 5/1990 | Fennell et al. | 49/362 X |

*Primary Examiner*—Philip C. Kannan

*Attorney, Agent, or Firm*—Leydig, Voit & Mayer

[57] ABSTRACT

A safety barrier assembly is disclosed to provide a movable barrier for an access passageway or doorway. The assembly includes a pair of upright support members and vertically travelling barrier means with at least two horizontally disposed elongate segments being selectively moveable between an operative passage blocking mode and inoperative non-blocking mode. Drive means are provided for moving the segments and lost motion means allow for positioning the segments a predetermined first distance apart when in the operative mode while positioning the segments close together when in the inoperative mode. Stop means may be provided for engaging one of the elongate members when in the operative mode.

9 Claims, 6 Drawing Sheets

SAFETY BARRIER ASSEMBLY

BACKGROUND OF THE INVENTION

In many loading dock areas, as well as in factories, warehouses, and other industrial areas in which moving equipment such as motorized forklifts are used, safety is important for the protection of personnel, equipment, and goods being handled. The danger of accidents increases in the vicinity of doorways or other passageways through which moving vehicles and/or personnel may travel at high rates of speed into other areas where they may collide with other vehicles, personnel, or obstacles.

There are inherent dangers associated with loading dock stations because loading docks typically are raised several feet with respect to the outside roadway and, moreover, trucks and semi-trailers are frequently moving immediately outside of the loading dock area. Because the passageways at loading dock stations involve high traffic situations to enable the loading or unloading of parked vehicles, it is desired to prevent forklifts from accidentally falling off the loading dock when a parked vehicle is not present. Forklifts are capable of traveling at high rates of speed while being difficult to handle and steer, particularly for inexperienced operators. Forklifts are also very heavy, which combined with their speed, results in large amounts of momentum and kinetic energy, making such forklifts difficult to stop.

Commercial and industrial doors are often subject to damage when they are inadvertently hit by forklifts or other large moving objects. Doors can sometimes prevent forklifts from traveling through the passageway, but many doors, particularly those made of fabric, plastic, or lightweight metal, may provide a false sense of security because they are not capable of stopping a forklift, and hence are subject to damage or disruption of the door as well as serious personal injury to the forklift driver and cargo, as well as other personnel, goods, and equipment which may be in the area.

Efforts have been made to provide substantially reinforced doors in an attempt to prevent such accidents, however, such doors are very expensive and the increased size and weight of the door are counterproductive because they result in slower travel of the door making it impossible to move the door either up or down fast enough to avoid accidents, as well as slowing the loading or unloading operation.

While there has been a long-felt need for a safety barrier to prevent accidental ingress or egress through a passageway, until recently such a barrier has been impractical. For example, a standard swinging gate mounted on a vertical post for pivotal movement about the vertical axis defined by the post, e.g., a barnyard gate, has not been practical in many industrial uses because of the time and effort involved in opening and closing such gates and because such gates can obstruct traffic even when in an open position.

Recently, a new safety gate assembly was invented and disclosed in U.S. patent application Ser. No. 07/799,032 (co-pending with this application) and also assigned to Rite-Hite Corporation. The safety gate of the latter application is hingedly mounted to a support member and pivotally movable in a substantially vertical plane. The pivotal safety gate, however, is inherently limited by the ratio of the width of the passageway to the height of the ceiling or other restrictions of the height to which the pivoting safety gate can travel.

SUMMARY OF THE INVENTION

It is an object of the invention to provide a safety barrier which will solve one or more of the problems noted above while avoiding the limitations of the prior art.

Thus, a safety barrier is provided which may be readily installed in existing or new structures, generally for use in proximity to passageways or doorways, such as those found in loading dock areas, factories, warehouses, and the like. The new safety barrier assembly can be operated in a variety of climatic conditions. When properly used, the safety barrier can help to prevent personal injury, damage to moving equipment and cargo, and damage to doors and other equipment.

Further and additional advantages of the improved safety barrier will become apparent from the description, accompanying drawings and appended claims.

In accordance with one embodiment of the invention, a safety barrier assembly is provided with is mounted in proximity to a passageway such as found in a loading dock at a loading/unloading station. The assembly includes a pair of stationary upright support members which can be positioned on opposite sides of the passageway. A vertically traveling barrier is mounted on the support members and includes at least one horizontal member, or elongate segment, which spans the distance between the support members. The safety barrier can be moved between an operative passage blocking mode and an inoperative non-blocking mode. The barrier travels substantially vertically, and preferably, when in the inoperative mode, the barrier is placed in a position above the flow of traffic. Drive means are provided for the safety barrier, in the form of an electric or hydraulic motor, a manual chain fall and sprocket, or one or two hydraulic cylinders.

Preferably, the barrier means includes two horizontal members or elongate segments which will be placed in predetermined positions when in an operative mode, effectively preventing undesired travel through the passageway. It may be desired to offset the upper elongate segment slightly rearwardly, so that a forklift approaching the front of the passageway will first intersect the lower segment, thereby reducing the moment arm through which such force will be transmitted to the loading dock floor. When in the raised or inoperative blocking mode, it is desired to position both segments as high as possible to maximize the head space. Therefore, the invention includes means to provide for a minimal distance between the two segments when they are in the inoperative mode.

One of the advantages of the present invention is that it is well adapted for use in proximity to passageways which are relatively wide with respect to the height of the ceiling or overhead restrictions. For example, the invention is suitable for use with a passageway that is 15 feet wide when the ceiling is 10 feet high. It will be understood that a wide variety of sizes of passageways will be accommodated by the present invention, both as to the width and height of the passageway. One or more stop means are provided which engage the barrier segments only when in the operative mode. The stop means limit the extent to which the elongate segments can travel in a downward direction. Operatively connected to the drive means is a safety means, such as a lower limit switch described below, which is responsive to a person or an object positioned under the safety barrier so as to obstruct downward movement of the lower segment. The optional safety means senses the obstructing object and may automatically interrupt movement of the elongate segments.

DESCRIPTION OF THE DRAWINGS

For a more complete understanding of the invention reference is made to the drawings wherein.

DESCRIPTION

Figures 1, 2:
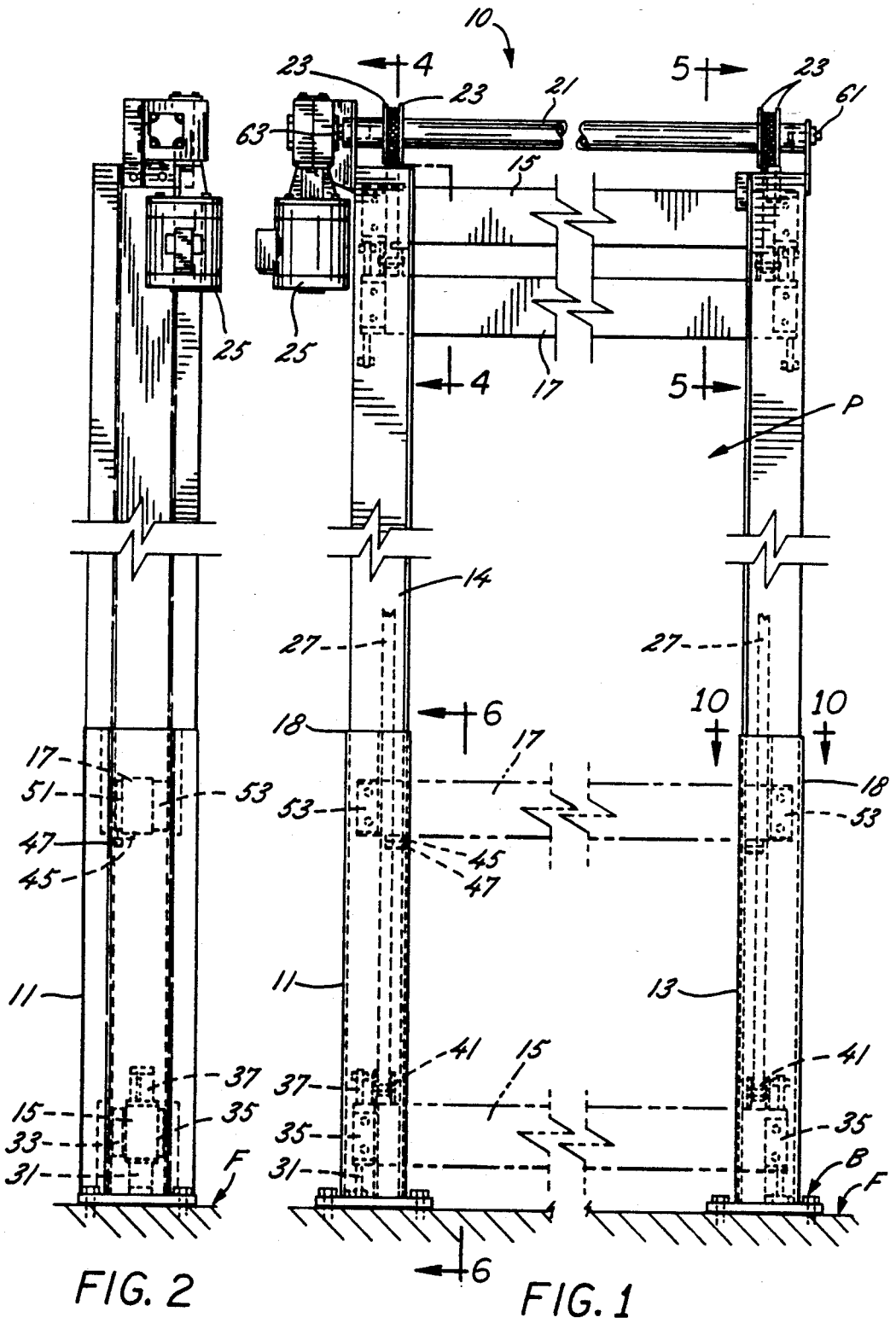
FIG. 1 is an inside front elevational view of the improved barrier assembly shown with the barrier assembly in an operative mode at the bottom of the figure, and with the barrier assembly in an inoperative mode at the top of the figure.
FIG. 2 is a left side elevational view of the improved barrier assembly of FIG. 1.
Figure 3:
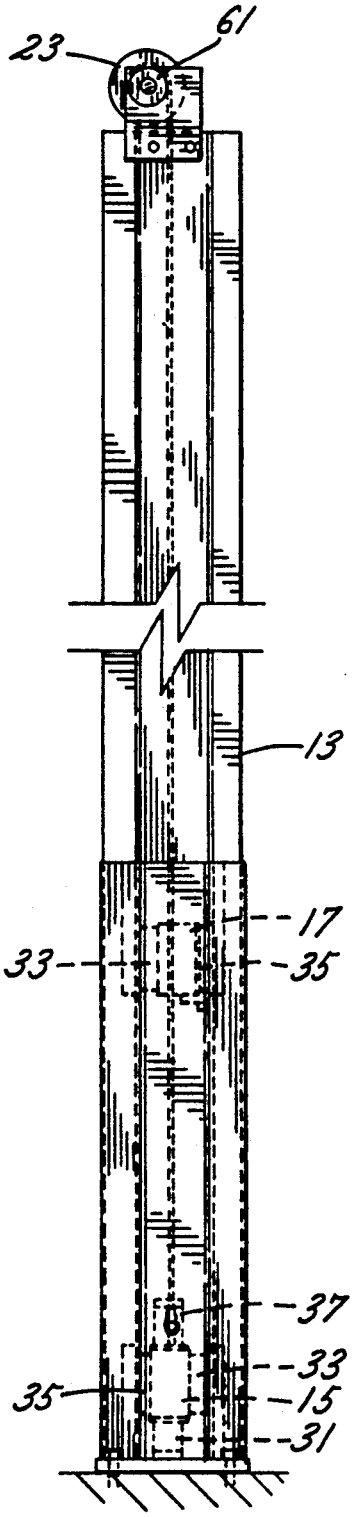
FIG. 3 is a right side elevational view of the assembly of FIG. 1.
Figure 10:
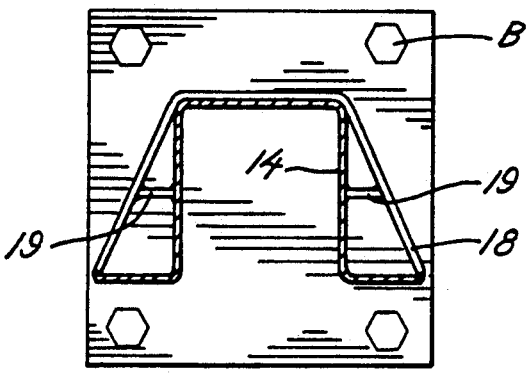
FIG. 10 is an enlarged sectional view taken along line 10—10 of FIG. 1.

Referring now to the drawings and more particularly to FIG. 1, one embodiment of the improved safety barrier assembly 10 is shown installed on a floor F in proximity to a passageway P. The floor and the passageway may be similar to that shown in U.S. patent application Ser. No. 07/799,032, also assigned to Rite-Hite Corporation. The safety barrier assembly 10, as illustrated, provides a safety barrier to prevent undesired or unintentional travel through passageway P. The safety barrier assembly 10, as illustrated, includes a pair of laterally spaced, upright post-like support members 11 and 13 which may be of like construction. One support member is disposed adjacent each side of the passageway and preferably within the building interior. The support members are laterally spaced apart a greater distance than the width of the passageway, thus not obstructing the use of the passageway during unloading/unloading operation. The support members 11 and 13 may be provided with track means 14 in which horizontal members or elongate segments 15 and 17 may travel a substantially vertical path. The track 14 may be more clearly understood by reference to FIG. 10, which also illustrates structural reinforcement means which may take the form of a support channel 18. The support channel 18 may be connected to the support members 11 and 13 by weld connections 19, see FIGS. 6 and 10. Support channel 18 shown in FIG. 10 may be used on the lower portions of the support members as shown in FIG. 1, or, alternatively, the reinforcement may take other forms and extend to other parts of the support members. The support members are attached to the floor by the use of bolts B, see FIG. 10, which should be of sufficient diameter and length and of satisfactory material, when considered in combination with the structural strength of the floor, to provide adequate anchoring for the support members and the possible forces to be encountered by the safety barrier when in the operative mode. If desired, additional structural reinforcement (not shown) can be provided by the use of rails, I-beams, or the like, which can be extended from the barrier assembly to the floor, walls, or ceiling of the building.

In the embodiment shown in FIG. 1, a header means is shown which may take the form of a drive member 21 which further adds to the structural stability of the safety gate assembly while also providing roller means for raising and lowering the safety barrier. In the alternative, rollers, pulleys, sprockets, or the like, may be used to provide roller means. The drive member 21 is provided with two pairs of strap guide flanges 23 which will be discussed momentarily. In this embodiment, an electrical gear motor drive 25 is shown, which is mounted on one of the upright support members, in this instance, support member 11. The electric gear motor drive 25 provides drive means for drive member 21, but it will be understood that other drive means such as a manual drive or hydraulic drive or the like may be used as alternative drive means.

Figure 7:
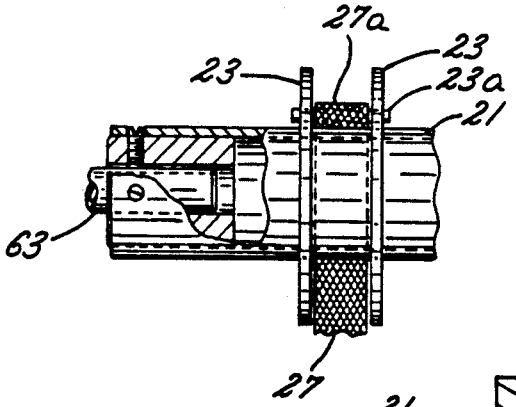
FIG. 7 is an enlarged fragmentary view showing the flanges 23 and drive shaft 63 in the upper left portion of FIG. 1.
Figure 8:
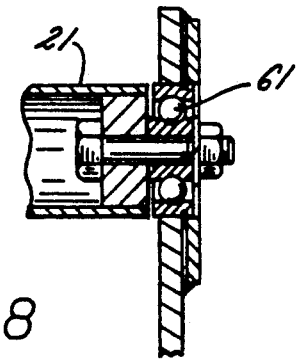
FIG. 8 is an enlarged fragmentary view of the drive member 21 and the idler bearing 61 at the upper right of FIG. 1.

As shown in FIG. 1, the electric gear motor drive 25 can be operated to rotate the drive member 21 and thereby raise or lower segment 15 and 17, while the straps 27 are being wound or unwound about the drive member 21 in the places provided by the strap guide flanges 23. Each strap 27 may be connected to drive member 21 at flanges 23 by means of a pin **23*a* inserted through a loop 27*a* sewn into the top of strap 27. See FIG. 7**. It will be understood that alternative strap means may be provided such as a chain, a rope, a wire rope cable, or the like.

Referring now to the bottom segment 15, a pair of feet 31, one at each end of the segment, provide for a resting position of the bottom segment at the bottom of the passageway. See FIGS. 1–4. The height of the bottom segment when in the operative position is a matter of design choice and can be varied easily by varying the length of feet 31 or by using other stop means such as metal brackets welded to support members 11 and 13 so as to intercept the segment when traveling in tracks 14 toward the down position.

A set of wear pads 33 and 35, preferably made of ultrahigh molecular weight polyethylene, is provided for each end of elongate segment 15. A corresponding (but reversed in size) set of wear pads 51 and 53 is provided for each end of elongate segment 17. In the embodiment shown, wear pads 33 and 53 are thick wear pads and pads 35 and 51 are relatively thin by comparison. The thick wear pads may be about one inch thick whereas the thin wear pads preferably are about 0.375 inches thick. The elongate segments 15 and 17 preferably are in the form of 5 inch by 3 inch rectangular tubes made of steel. In the preferred embodiment the upper elongate segment is offset from the lower elongate segment by reversing the wear pads. Thus, FIGS. 1 and 2 show that the bottom segment 15 is provided with a thick wear pad 33 at the rear of the assembly while segment 17 is provided with a thick wear pad 53 at the front of the assembly. The reason for the offset is that an impact such as from a forklift can be expected to occur at the front of the assembly, and it is desired for the maximum force from the impact to be transmitted to the lower segment to shorten the moment arm between the point of impact and the floor.

Figure 4:
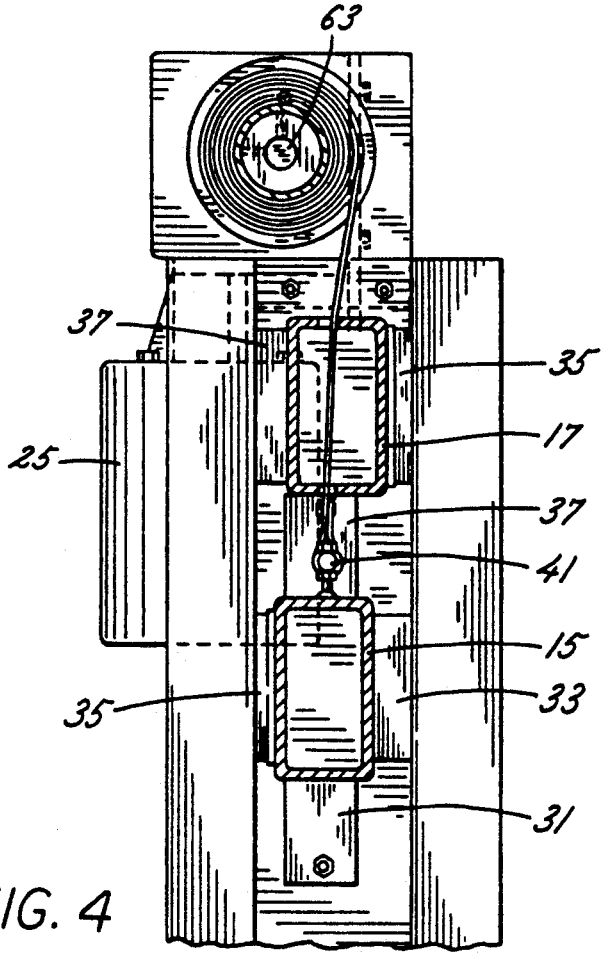
FIG. 4 is an enlarged sectional view taken along line 4—4 of FIG. 1.
Figure 9:
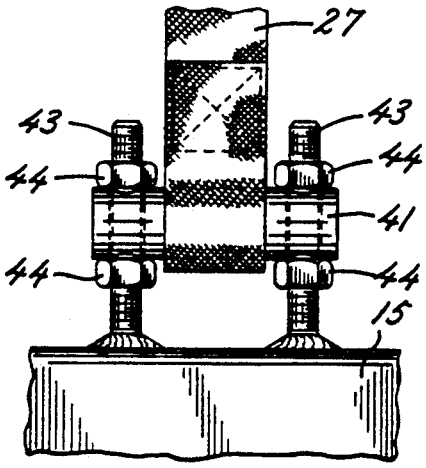
FIG. 9 is an enlarged sectional view taken along line 9—9 of FIG. 6.

The lower segment 15 shown in FIGS. 1–4 is also provided with a spacer 37 so that when the lower segment 15 is raised, the spacer 37 will contact the upper segment 17 and raise the upper segment to inoperative position, see FIG. 4. The straps 27 are attached to each end of lower segment 15 through the use of two anchor bars 41 shown on FIG. 1. See also FIGS. 4, 6, and 9. The bolts 43 are provided nuts 44 which can be adjusted to fasten the anchor bar to the bolts while also allowing some degree of adjustment or positioning of the anchor bar with respect to bolts 43 and lower segment 15.

Upper segment 17 is provided with a foot 45 at each end thereof and in the operative position the foot 45 rests on a stop member 47 welded to support members 11 and 13. Upper segment 17 is provided with a set of wear pads at each end thereof, including a thin wear pad 51 and a thick wear pad 53. At each end of upper segment 17 a slot 55 is provided in the top as well as in the bottom of the segment allowing straps 27 to pass through the segment for connection to anchors 41 and to drive member 21.

Figure 5:
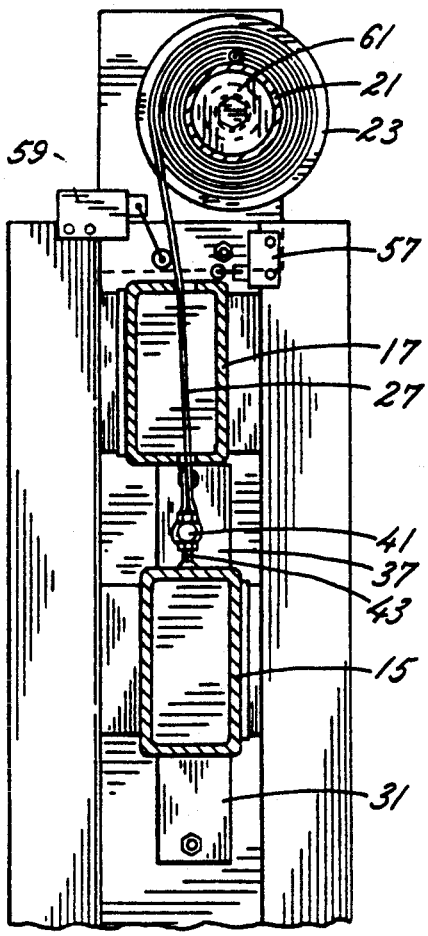
FIG. 5 is an enlarged sectional view taken along line 5—5 of FIG. 1.

In operation, the strap 27 is wound by rotating the drive member 21 thereby lifting lower segment 15 until spacer 37 contacts upper segment 17, whereupon the two segments travel together until they reach the inoperative position at the top of he upright support members. An upper limit switch 57 may be provided as shown in FIG. 5 to detect the presence of upper segment 17 at the upper end of a support member, whereupon the switch can then turn off the motor 25.

The process of lowering the elongate segments is accomplished by reversing the direction of drive member 21 thereby unwinding straps 27 which in turn lowers the lower segment 15 to its operative position. Upper segment 17 is carried by lower segment 15 until upper segment 17 comes to rest on stop member 47 whereupon its motion stops and it is in the operative position.

Figure 6:
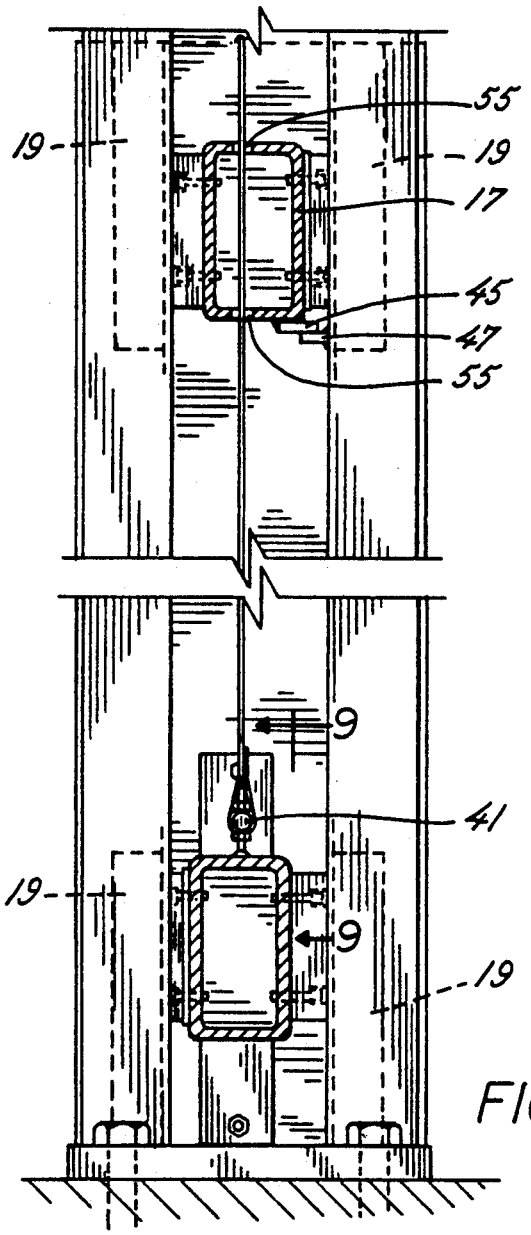
FIG. 6 is an enlarged sectional view taken along line 6—6 of FIG. 1.

The phenomenon of the present invention whereby the lower segment 15 may be in motion after the upper segment 17 is stopped on the way to the lowermost travel of segment 15 may be described as lost motion. In the preferred embodiment, lost motion means are provided through the use of straps 27 and slots 55 as shown in FIG. 6. A variety of other mechanisms for producing lost motion could be provided as alternatives, through the use of gears, sprockets, clutches, wires, ropes, cables, or the like. Moreover, it may be desired to use control devices such as a programmable array logic (PAL) programmable logic control (PLC) or a microprocessor to effect such lost motion. Regardless of the particular means selected for producing this phenomenon, it can be appreciated that the horizontal elongate segments 15 and 17 are positioned an optimum vertical distance apart while in the operative mode, but are positioned closely together when in the inoperative mode to maximize the amount of head space available in the passageway.

When the lower segment 15 is being lowered to its operative position, at the end of its travel the horizontal segment 15 comes to rest upon its feet 31 at which time lower limit switch 59 is triggered by the slack in strap 27 which results from any continued rotation of drive member 21. See FIG. 5. Accordingly, when the lower segment 15 reaches its operative position, the electric motor 25 is automatically shut off by the lower limit switch 59.

Returning to the drive member 21 shown at the top of FIG. 1, the right side of drive member 21 is mounted at the top of upright support member 13 through the use of a bracket and an idler bearing 61. See FIG. 5. Similarly, the left end of drive member 21 is mounted at the top of upright support member 11. By use of a suitable bracket, the drive member 21 is connected to the electric motor 25 with output shaft 63. See FIGS. 1 and 7. Other suitable drive member connections such as conventional couplings, guide and bearing collars with locking set screws, etc., may be utilized.

An alternative embodiment of the safety barrier assembly of this invention employs a manual operating mechanism such as the chain fall and sprocket shown in FIGS. 11–15. When possible, the element numbers used to identify parts of the alternative embodiment will correspond to numbers used for the electric-drive embodiment except that a 100 series will be used.

Figures 11, 12:
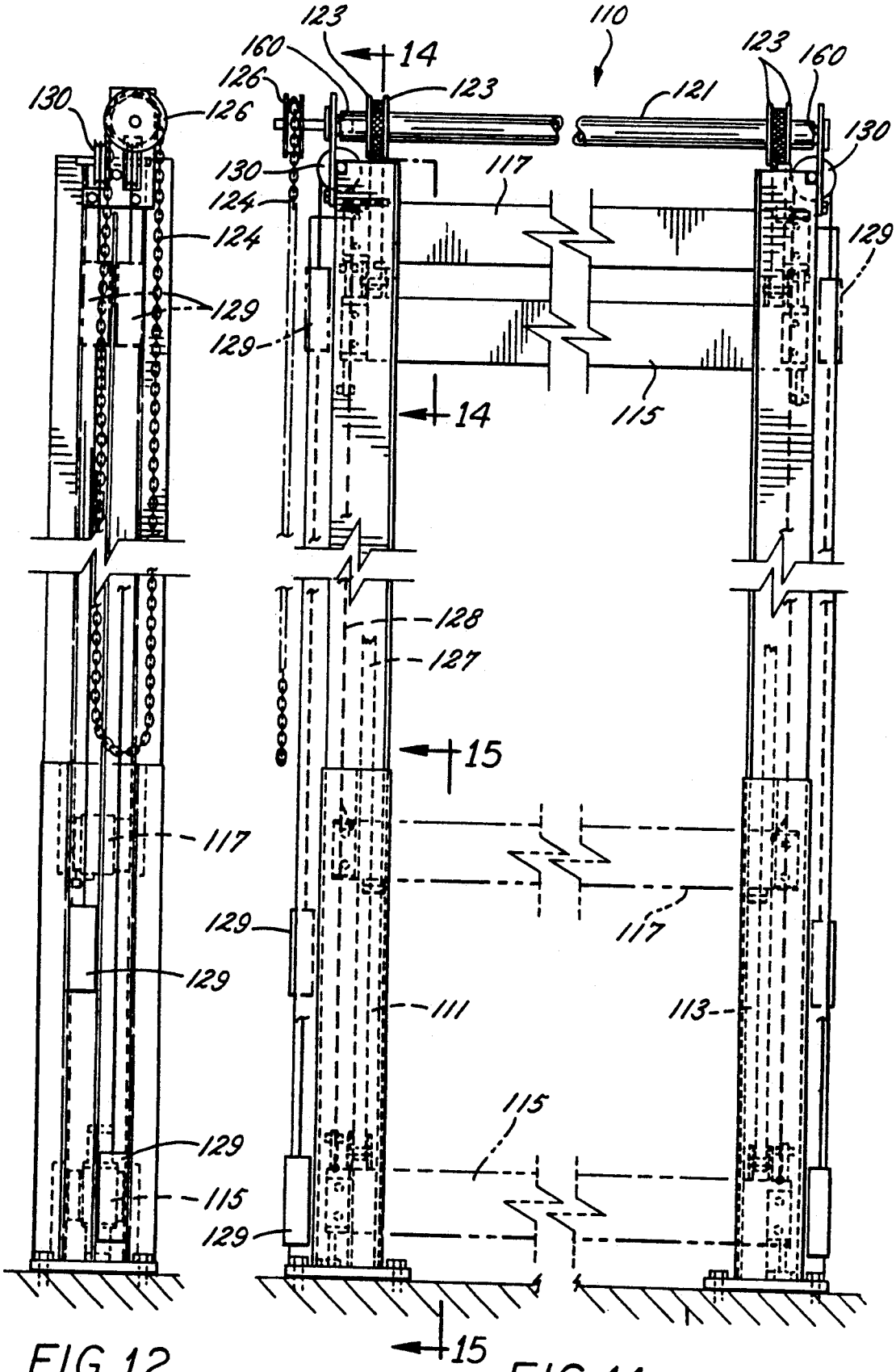
FIG. 11 is a front elevational view of an alternative embodiment of the invention using a manual chain fall and sprocket drive.
FIG. 12 is a left side elevational view of the assembly shown in FIG. 11.
Figure 13:
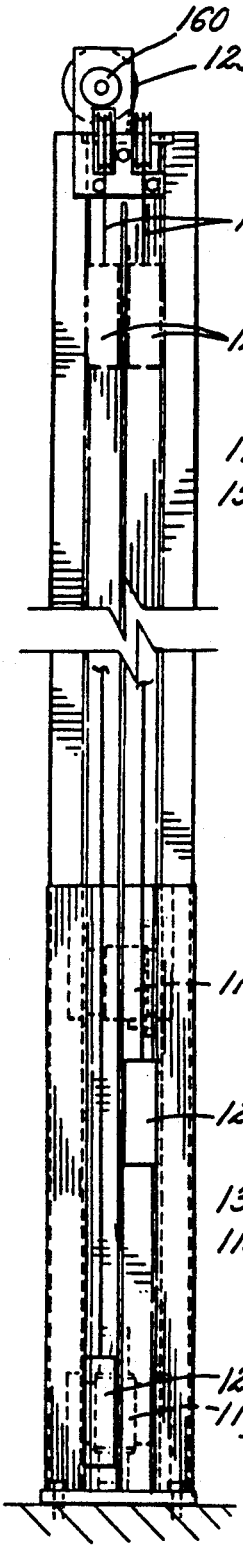
FIG. 13 is a right side elevational view of the assembly shown in FIG. 11.

The alternative safety gate assembly 110 shown in FIG. 11 includes an upright post-like support member 111 positioned on one side of the passageway, while another upright support member 113 is positioned on the other side of the passageway.

Figure 15:
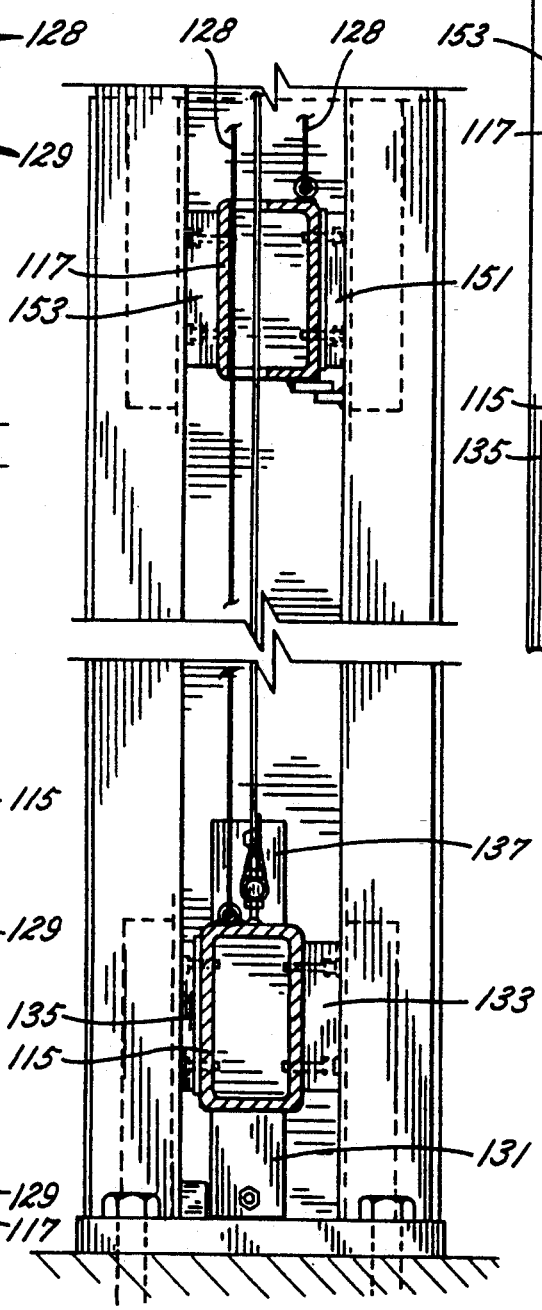
FIG. 15 is an enlarged sectional view taken along line of 15—15 of FIG. 11.
Figure 14:
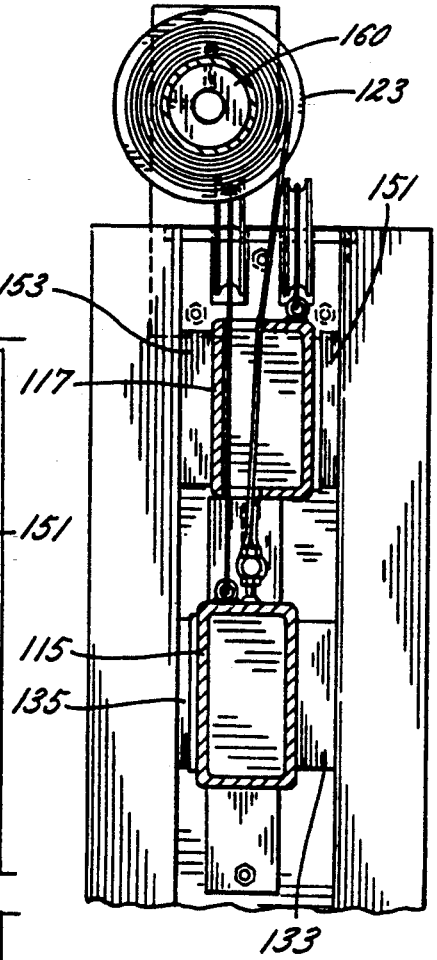
FIG. 14 is an enlarged sectional view taken along line 14—14 of FIG. 11.

The manually operated safety barrier assembly of FIG. 11 includes a lower elongate segment 115 and an upper elongate segment 117. A header means which is shown in the form of a drive member 121 is provided with two sets of flanges 123. The drive means provided for the drive member 121 includes a manual chain fall 124 which can be used to rotate sprocket 126 and thereby turn drive member 121 to wind or unwind the straps 127. It will be understood that a variety of manual drive means for operating the drive member 121 can be used through various combinations of gears, pulleys, cables, ropes, straps, or the like. The manually operated safety barrier assembly 110 includes wire rope cables 128 which are attached to counterweights 129 and segments 115 and 117. The wire rope cables 128 travel on pulleys 130 to raise or lower the counterweights which balance the respective segments. As shown in FIG. 15, a foot 131 is attached to the bottom of lower segment 115 and a thick wear pad 133 and a thin wear pad 135 are provided on respective sides of lower segment 115.

Similarly, upper elongate segment 117 is provided with a thin wear pad 151 and a thick wear pad 153, the relative positions of the wear pads being reversed from the positions for the lower wear pads. In the manual safety barrier assembly, the drive member 121 is supported at each end by a support bearing 160, see FIGS. 11, 13, and 14.

Figures 16, 17:
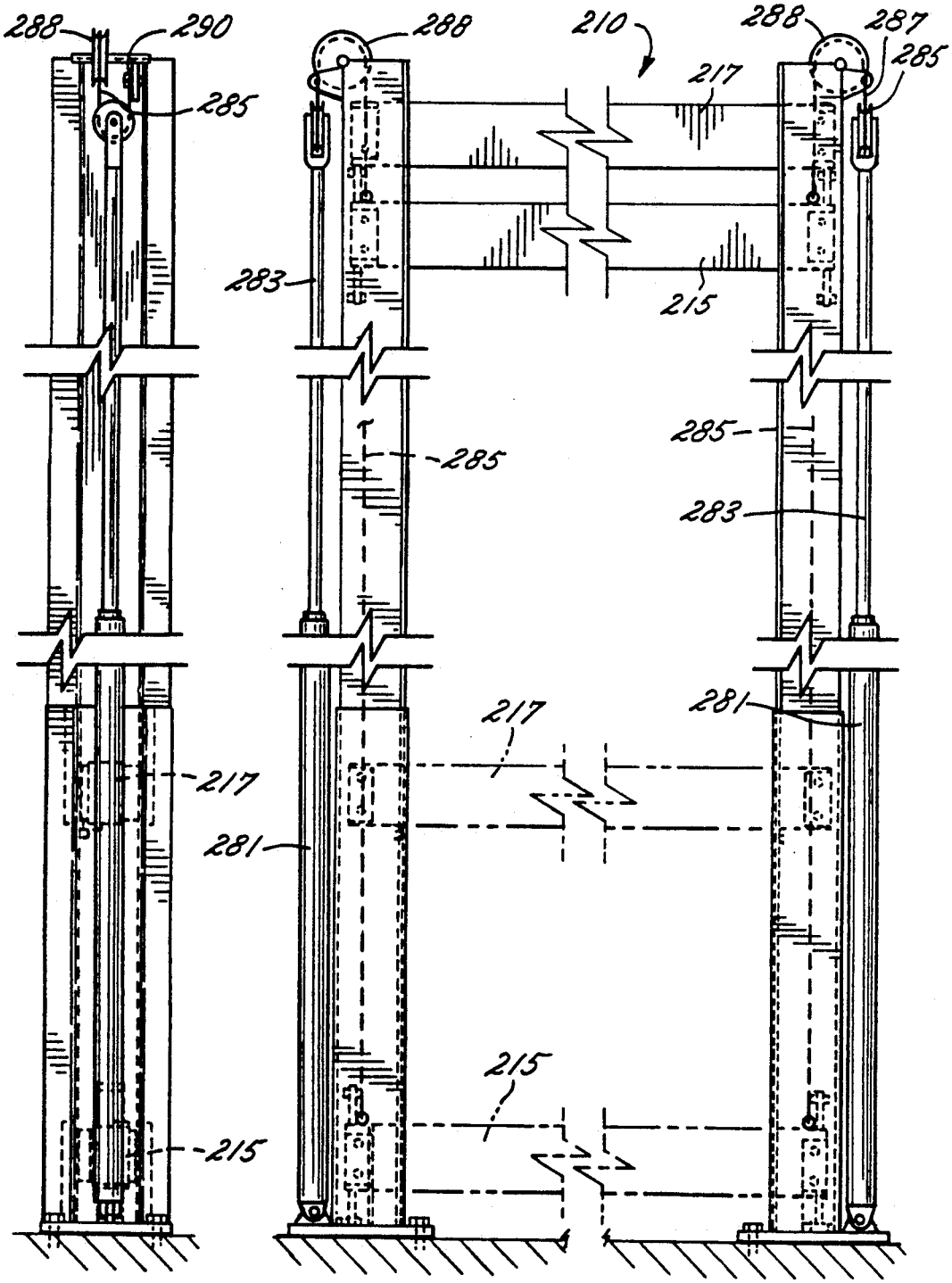
FIG. 16 is a front elevational view of an alternative embodiment of the invention using hydraulic cylinders as the drive means.
FIG. 17 is a left side elevational view of the assembly shown in FIG. 16.

A further alternative embodiment of the safety barrier assembly provides for hydraulic means to raise and lower the elongate segments, as shown in FIGS. 16 and 17. The hydraulic safety barrier assembly 210 shown in FIG. 16 includes a lower elongate segment 215 and an upper elongate segment 217. No header in the form of drive member 21 or 121 is required for the hydraulic safety barrier assembly, thereby further reducing the potential for interference with dock door or building components to achieve a given inoperative mode. A hydraulic cylinder 281 fitted with a piston 283 is provided for each side of the passageway and a wire rope cable 285 is affixed at the top of each upright support member from which it travels through a pulley 285 and another pulley 288 through slots provided in upper elongate segment 217 and connecting to lower elongate segment 215. In operation, when the piston is raised to its uppermost height, the wire rope cable 285 will allow the elongate segments to descend to their respective operative positions. When the hydraulic piston 283 is fully retracted, the wire rope cable 287 will raise the lower elongate segment 215 until it intersects upper elongate segment 217 and the two elongate segments are then fully raised to their inoperative position. It will be understood that the two cylinders 281 should be operated to achieve synchronized motion on each side of the assembly, through the use of metering pumps, switches, or the like, as known in the art.

Thus an improved safety barrier assembly has been provided which is effective for providing a safety barrier in proximity to a passageway such as commonly found in loading dock stations. The improved safety barrier assembly is adaptable for a wide range of passageways, including passageways which are relatively wide in comparison to the height of the ceiling or other overhead restrictions. Moreover, a variety of drive means may be provided, such as electric, manual, or hydraulic, and through the use of lost motion means, it is possible to optimally position the barrier means in the operative mode while minimizing the amount of space required for the barrier means when in the inoperative mode.

We claim:

1. A safety barrier assembly mountable in proximity to an access passageway, said assembly comprising a pair of stationary, laterally spaced, upright support members positionable on opposite sides of the passageway; vertically travelling barrier means mounted on said support members and including two horizontally disposed elongate segments spanning the distance between said support members, said segments being selectively movable between an operative passage-blocking mode and an inoperative non-blocking mode, the movement of said segments being in a part defining a substantially vertical plane; said support members including a vertically extending track means for receiving respective ends of the elongate segments to guide the elongate segments in said path, drive means having an actuatable element operatively connected to one of said segments and effecting controlled movement of the latter between said modes; lost motion means for spacing said segments a predetermined first distance apart from each other when in the operative mode and for providing relative vertical movement of said elongate segments during said controlled movement to position said segments a predetermined second distance apart when in the inoperative mode, said second distance being substantially less than said first distance; and stop means mounted for engaging said segments only when the latter assume the operative mode.

2. The safety barrier assembly of claim 1 further comprising structural reinforcement means for reinforcing said support members in the vicinity of the ends of said segments when in the operative mode.

3. The safety barrier assembly of claim 1 wherein said drive means comprises an electric motor operatively connected to said actuatable element.

4. The safety barrier assembly of claim 1 wherein said drive means comprises a manually operated chain and sprocket operatively connected to said actuatable element.

5. The safety barrier assembly of claim 1 wherein said drive means comprises a vertically extending hydraulic piston operatively connected to said actuatable element.

6. The safety barrier assembly of claim 1 wherein one segment is positioned above the other segment and the upper segment is movable in response to the movement of the lower segment.

7. The safety barrier assembly of claim 6 wherein said drive means comprises strap means operatively connected to one segment for moving said segment; and roller means operatively connected to said strap means for rolling said strap means to effect said movement.

8. The safety barrier assembly of claim 7 wherein said lost motion means comprise slots in the upper segment through which said strap means are threaded.

9. The safety barrier assembly of claim 6 wherein each end of said elongate segments include offset means said offset means being cooperable with said support members for receiving a larger force on impact from a moving object in the lower segment than in the upper segment.

* * * * *

UNITED STATES PATENT AND TRADEMARK OFFICE

CERTIFICATE OF CORRECTION

PATENT NO. : 5,271,183

DATED : December 21, 1993

INVENTOR(S) : NORBERT HAHN, GREGORY S. HAHN AND MICHAEL A. SWESSEL

It is certified that error appears in the above-identified patent and that said Letters Patent is hereby corrected as shown below:

Column 5, line 44, delete "he" and substitute therefor -- the --.

Column 8, line 2, delete "part" and substitute therefor -- path --.

Signed and Sealed this

Thirtieth Day of August, 1994

*Attest:*

*Attesting Officer*

Bruce Lehman

BRUCE LEHMAN

*Commissioner of Patents and Trademarks*